US012668851B2

(12) United States Patent
Buller et al.

(10) Patent No.: US 12,668,851 B2
(45) Date of Patent: Jun. 30, 2026

(54) THERMAL TREATMENT OF COMPONENT

(71) Applicant: Schwartz GmbH, Simmerath (DE)

(72) Inventors: David Buller, Hürtgenwald (DE); Andreas Reinartz, Monschau (DE)

(73) Assignee: Schwartz GmbH, Simmerath (DE)

( * ) Notice: Subject to any disclaimer, the term of this patent is extended or adjusted under 35 U.S.C. 154(b) by 431 days.

(21) Appl. No.: 18/020,150

(22) PCT Filed: Aug. 9, 2021

(86) PCT No.: PCT/EP2021/072123

§ 371 (c)(1),
(2) Date: Feb. 7, 2023

(87) PCT Pub. No.: WO2022/037979

PCT Pub. Date: Feb. 24, 2022

(65) Prior Publication Data

US 2023/0304116 A1 Sep. 28, 2023

(30) Foreign Application Priority Data

Aug. 18, 2020 (DE) ..... 102020121672.6

(51) Int. Cl.
*C21D 9/00* (2006.01)
*C21D 1/06* (2006.01)
(Continued)

(52) U.S. Cl.
CPC ..... *C21D 9/0062* (2013.01); *C21D 1/06* (2013.01); *C21D 1/18* (2013.01); *C21D 1/667* (2013.01); *C21D 2221/00* (2013.01)

(58) Field of Classification Search
CPC . C21D 1/06; C21D 1/18; C21D 1/667; C21D 2221/00; C21D 9/0062
(Continued)

(56) References Cited

U.S. PATENT DOCUMENTS

2020/0040415 A1* 2/2020 Reinartz ..... C21D 1/667
2020/0232053 A1* 7/2020 Wilden ..... C21D 11/005

FOREIGN PATENT DOCUMENTS

CN 107739794 A 2/2018
CN 110462068 A 11/2019
(Continued)

OTHER PUBLICATIONS

JC Gupta & Sons. "Spacers and Standoffs". Available since Aug. 10, 2020 via Wayback Machine. https://www.jcfasteners.com/products/spacers-and-standoffs/. Accessed May 14, 2025 (Year: 2020).*
(Continued)

*Primary Examiner* — Rebecca Janssen
*Assistant Examiner* — Mayela Aldaz
(74) *Attorney, Agent, or Firm* — Young Basile Hanlon & MacFarlane, P.C.

(57) ABSTRACT

An apparatus for thermal treatment of a component includes a heating portion and a downstream cooling portion, separated by a partition wall. The cooling portion has a nozzle for discharging a cooling fluid, with the nozzle being inclined toward the component and away from the heating portion. An outer wall of the nozzle, facing the heating portion, is arranged parallel to and spaced apart from the partition wall. This parallel arrangement forms a defined gap that guides entrained air, thereby achieving a sharply delimited thermal separation between the heating and cooling portion.

8 Claims, 2 Drawing Sheets

(51) Int. Cl.
*C21D 1/18* (2006.01)
*C21D 1/667* (2006.01)

(58) Field of Classification Search
USPC ..... 266/259
See application file for complete search history.

(56) References Cited

FOREIGN PATENT DOCUMENTS

| | | | | | |
|---|---|---|---|---|---|
| DE | 3321554 | C1 | | 2/1984 | |
| DE | 102017107549 | A1 | * | 10/2018 | ..... C21D 1/18 |
| EP | 3027782 | A1 | | 6/2016 | |
| WO | WO-2018087191 | A1 | * | 5/2018 | ..... C21D 11/005 |

OTHER PUBLICATIONS

International Search Report, PCT Application No. PCT/EP2021/072123, mailed Nov. 11, 2021 (3 pages).

* cited by examiner

THERMAL TREATMENT OF COMPONENT

CROSS REFERENCE TO RELATED APPLICATIONS

This application is a 371 national stage application of International Application No. PCT/EP2021/072123, filed Aug. 9, 2021, which claims the benefit of the filing date of German Application No. 102020121672.6, filed Aug. 18, 2020, the contents of which are hereby incorporated by reference in their entireties.

FIELD OF INVENTION

The invention relates to an apparatus for the thermal treatment of a component, more particularly steel components for motor vehicles.

BACKGROUND

In the automotive industry in particular, it is known to selectively harden steel components by thermal treatment. For this purpose, steel components, such as B-pillars, are thermally treated in a manner that varies from region to region. Accordingly, hardness varies from region to region, which is advantageous for the crash behavior of such components.

A wide variety of methods is known for treating steel components in a manner that varies from region to region. All the known methods have in common that an insufficient delimitation between the individual temperature ranges is achieved. This makes it particularly difficult to simulate the behavior of components treated in this way in the event of an accident.

Proceeding from the prior art described, it is the object of the present invention to provide an apparatus for the thermal treatment of a component by means of which, regions of the component can be thermally treated in a manner in which they are separated from one another in a particularly defined manner.

SUMMARY

This object is achieved by means of the apparatus according to the independent claim. Advantageous embodiments of the apparatus are specified in the dependent claims. The features presented in the claims and in the description can be combined with one another in any technologically meaningful way.

According to the invention, an apparatus for the thermal treatment of a component is provided. The component can be arranged in a component plane in the apparatus, which component plane is spanned by a first direction and a second direction perpendicular to the first direction. The apparatus comprises:

- a heating portion having a heating means for heating a first region of the component,
- a cooling portion having a cooling means for cooling a second region of the component;

wherein the cooling portion is downstream of the heating portion in the second direction;

wherein the cooling means has a nozzle for discharging a cooling fluid onto the component;

wherein the nozzle is oriented such that it drops in the second direction; and wherein the nozzle has a fluid channel having a nozzle opening.

The apparatus is described using a coordinate system which has a first direction, a second direction and a third direction, which are perpendicular to one another. The first direction and the second direction together define a plane which is referred to as the component plane. The apparatus does not comprise a component, but is intended and configured to receive a component. Thus, a component can be inserted into the apparatus in such a way that the component is located in the component plane. An extension of the component in the third direction can be disregarded.

The apparatus is particularly suitable for the thermal treatment of a steel component, in particular a steel component for a motor vehicle. For example, a B pillar can be such a component. The apparatus can also be referred to as a temperature-control station. A component treated with the apparatus is preferably removed from the apparatus and subsequently hardened. In this case, the apparatus is part of an arrangement with a press downstream of the apparatus.

With the apparatus, the component can be thermally treated in a manner that varies from region to region. For this purpose, the apparatus has a heating portion and a cooling portion. The cooling portion is downstream of the heating portion in the second direction. The cooling portion and the heating portion are thus located one behind the other when viewed along the second direction. The second direction is from the heating portion to the cooling portion. Preferably, the cooling portion and the heating portion adjoin one another.

A first region of the component can be heated in the heating portion. A second region of the component can be cooled in the cooling portion. This can take place simultaneously. The component can be inserted into the apparatus, preferably in or counter to the first direction. The component can be thermally treated in the apparatus. During thermal treatment, the component is preferably at rest. After thermal treatment, the component can be moved out of the apparatus, preferably in or counter to the first direction. However, it should be noted here that the first direction is generally defined independently of the direction of movement of the component. If the component is moved in the first direction, the direction of movement of the component coincides with the first direction. Alternatively, however, the component can also be moved in any other direction.

The first region and the second region of the component are different from one another. Preferably, the component is divided into the first region and the second region, i.e., has no further regions. Alternatively, however, the component can also have further regions in addition to the first region and the second region. The first region and the second region preferably, but not necessarily, form a contiguous region in each case. The first region and the second region of the component are defined in the component plane.

Due to different thermal treatment, the first region is harder than the second region during subsequent hardening. This can be used, for example, to make a flange of a B pillar (as a second region) softer than the rest of the B pillar (as a first region). As a result, in addition to the targeted adjustment of crash properties, the assembly of the B pillar can also be facilitated. In particular, rivets and crimping are thus made possible. During welding, the risk of cracking in the heat-affected zone of the welding spots is reduced.

Cooling in the cooling portion is preferably carried out by applying a cooling fluid to the component in the second region, said cooling fluid being discharged from the nozzle. The cooling fluid is preferably gaseous. Compressed air or nitrogen are preferred as cooling fluid. The cooling fluid is preferably discharged at a pressure in the range of 2 to 4 bar.

The nozzle preferably does not touch the component. The apparatus is thus particularly tolerant with regard to positioning errors and deformations of the component due to temperature and/or inherent stress.

The nozzle is preferably designed as a slotted nozzle. Preferably, the nozzle opening and in particular also the fluid channel upstream thereof has a flow cross section, which has an aspect ratio of at least 1 to 5. This means that the flow cross section in one direction (preferably along the first direction) has an extension which is greater by a factor of at least 5 than the extension of the flow cross section perpendicular to this direction. The nozzle is preferably oriented such that the longer side of the nozzle opening is oriented parallel to the component plane. A particularly uniform flow of the cooling fluid can be achieved by means of a slotted nozzle. For this purpose, it is particularly preferred for the nozzle opening to have sharp edges.

The nozzle is oriented such that it drops in the second direction. When viewed from the heating portion in the direction of the cooling portion, the nozzle is therefore inclined downwards in the direction of the component plane. If a component is located in the apparatus, the nozzle is oriented obliquely on the component in the second direction. The orientation of the nozzle relates to the direction in which the cooling fluid is discharged from the nozzle. If this is done in the form of a flat jet, the orientation is defined by means of the center of gravity of the flat jet, i.e., along an axis of the flat jet.

As a result of the described orientation of the nozzle, the cooling fluid is discharged in a direction which is directed away from a component located in the apparatus and away from the heating portion. After the cooling fluid has impinged on the component, the cooling fluid flows along the component surface in the second direction. The cooling fluid thus has a momentum with a component pointing in the second direction and thus away from the heating portion. As a result, the second region of the component can be cooled, wherein particularly little cooling fluid enters the heating portion. In this respect, a particularly defined delimitation of the thermal treatment of the first region and of the second region can be achieved. The width of the transition region can be reduced to an unavoidable minimum resulting from the heat conduction within the component. The described embodiment can be referred to as an "aerodynamic seal" between the heating portion and the cooling portion.

Tests have shown that the delimitation between the first region and the second region can be further reinforced by the nozzle having a fluid channel with a straight portion upstream of the nozzle, which is consequently preferred. The fluid channel is therefore preferably formed straight at least in the portion adjoining the nozzle opening. In this case, the cooling fluid flows along a straight flow path immediately before it emerges from the nozzle opening. This achieves a particularly uniform jet formation. This causes particularly little of the cooling fluid to reach the heating portion. A particularly defined delimitation of the regions of the component can thus be achieved. In addition, the second region can be cooled particularly uniformly by the uniform jet formation. As an alternative to a straight portion upstream of the nozzle opening, a curved portion can also be arranged upstream of the nozzle opening. This can be expedient depending on the component geometry.

It has been found that a particularly uniform jet formation is achieved, in particular in the preferred embodiment of the apparatus, in which the fluid channel has a straight portion, which is upstream of the nozzle opening and has a length of at least 5 mm.

The length of the straight portion is measured along the fluid channel. Preferably, the straight portion of the fluid channel has a length in the range of 5 mm and 40 mm, in particular in the range of 10 to 15 mm.

In a further preferred embodiment of the apparatus, an outer wall of the nozzle facing the heating portion drops at least partially in the second direction.

The cooling fluid has a very high outlet speed at the nozzle opening. According to physical laws, a strong negative pressure is created, which leads to large quantities of air being entrained from the surroundings of the nozzle opening. The overall moved mass flow can be up to 100 times higher than the mass flow of the cooling fluid. This circumstance allows the component to be cooled particularly efficiently. In the present embodiment, this applies all the more since the flow of the entrained air is guided in a targeted manner from the surroundings of the nozzle opening. For this purpose, the outer wall of the nozzle facing the heating portion is used as a guide surface. This outer wall of the nozzle drops at least partially in the second direction. As a result of this drop, air is entrained from the surroundings of the nozzle opening in such a way that the entrained air flows away onto the component and away from the heating portion. Like the cooling fluid itself, the entrained air thus flows such that particularly little of the entrained air reaches the heating portion. This also contributes to delimiting the regions of the component in a particularly defined manner.

It is preferred that the outer walls of the nozzle have no sharp edges. Air can thus flow around the nozzle with as little resistance as possible, so that the air can reach the nozzle opening as unhindered as possible.

In a further preferred embodiment, the apparatus further comprises a partition wall between the heating portion and the cooling portion, wherein an outer wall of the nozzle facing the heating portion is spaced apart from the partition wall in the second direction.

The partition wall can also be referred to as a bulkhead. The partition wall can be used to separate the first region and the second region from one another in a particularly defined manner. The partition wall is preferably oriented parallel to the outer wall of the nozzle facing the heating portion. The partition wall preferably extends to just above the component, so that a remaining gap between the component and the partition wall is as small as possible. In order to be able to treat components of different thicknesses in the apparatus, the partition wall is preferably designed such that this gap has an adjustable extension.

The outer wall of the nozzle facing the heating portion is spaced apart from the partition wall in the second direction. A gap is therefore formed between the partition wall and the nozzle, through which the air that is entrained at the nozzle opening with the cooling fluid can flow. By means of such an air flow, a particularly large quantity of air can be entrained by the cooling fluid at the nozzle opening, so that the second region of the component can be cooled particularly efficiently.

The partition wall is preferably part of a nozzle box which comprises a cover plate next to the partition wall. In a preferred embodiment, the cover plate is comprised in the apparatus and is arranged above the nozzle in the cooling portion. The partition wall and the cover plate preferably adjoin one another and can even be formed in one piece with one another.

The nozzle box formed by the partition wall and the cover plate preferably represents at least part of a delimitation of the cooling portion. The second region of the component can be cooled particularly efficiently by the nozzle box. In particular, a spread of the cooling fluid can be restricted by the nozzle box, whereby the consumption of the cooling fluid can be kept low.

In a further preferred embodiment, the apparatus further comprises a guide plate which is arranged in the cooling portion on a side of the nozzle facing away from the heating portion and parallel to the component plane.

When viewed along the second direction, the sequence in this embodiment is as follows: Heating portion, optional partition wall, cooling portion with—in this order—nozzle and guide plate.

The guide plate is preferably arranged at a distance from the nozzle so that air can flow between the nozzle and the guide plate. This air can be entrained by the cooling fluid emerging from the nozzle opening. This takes place in addition to the air which flows along the outer wall of the nozzle facing the heating portion and is likewise entrained by the cooling fluid emerging from the nozzle opening.

The guide plate is oriented parallel to the component plane, i.e., it lies in a plane that is spanned by the first direction and the second direction. In this plane, the guide plate preferably extends so far that it almost completely covers the second region of the component. The guide plate preferably has an extension in the range of 10 to 200 mm in the first direction. The guide plate preferably has an extension in the range of 50 to 250 mm in the second direction.

The guide plate is arranged in the third direction above the component plane, i.e., on the side of the component on which the nozzle is also arranged. The guide plate forms a channel with the component, through which the cooling fluid and the air entrained by the cooling fluid can flow via the component. This channel is to be distinguished from the fluid channel within the nozzle. By means of the guide plate, it is possible to prevent undesirable turbulence. This can occur in particular in the case of components with a large extension in the second direction. As a result of the guide plate, the apparatus is therefore particularly suitable for large components.

In a further preferred embodiment of the apparatus, an edge of the guide plate facing the nozzle is rounded.

A rounded edge can be obtained in particular by bending the edge of a thin guide plate or by mechanically machining the edge of a thick guide plate so that an initially sharp edge is broken.

The rounded edge of the guide plate improves the flow of the cooling fluid and the air entrained by the cooling fluid. In particular, turbulence is reduced or even prevented, which could arise at a sharp edge. In addition, in particular in the case of a thin guide plate, its stability can be improved by the rounded edge.

In a further preferred embodiment of the apparatus, at least one spacer pin is arranged on the guide plate in order to hold the component at a distance from the guide plate.

The flow rate remains approximately constant in the channel formed by the guide plate and the component. A negative pressure in the channel can therefore lead to buoyancy forces. Thin and/or large components can thereby be raised. In the present embodiment, this is limited by the spacer pins. The at least one spacer pin is preferably oriented along the third direction. The at least one spacer pin preferably extends from the guide plate counter to the third direction, in particular up to a position that is located just above the component surface during normal operation.

In a further preferred embodiment of the apparatus, the fluid channel has a uniform width in the range of 0.1 to 3 mm in a straight portion upstream of the nozzle opening perpendicular to the first direction.

The width of the fluid channel perpendicular to the first direction is defined as the smallest distance between the two opposite side walls of the fluid channel when viewed in a plane perpendicular to the first direction. In the present embodiment, this width is equal throughout the straight portion and is in the range of 0.1 to 3 mm. The flow cross section for the cooling fluid results from the thus defined width and the extension of the fluid channel along the first direction. Preferably, the fluid channel extends along the first direction in the range of 10 to 300 mm, in particular in the range of 60 and 100 mm. As a result, sufficient cooling fluid can be applied to the second region in order to cool the second region.

If the width of the fluid channel is in the specified range, a sharply delimited flow of the cooling fluid over the component surface can be achieved. In addition, air from the surroundings of the nozzle opening can be entrained particularly efficiently. Overall, the described width of the fluid channel thus results in a particularly efficient cooling of the second region of the component.

In a further preferred embodiment of the apparatus, the nozzle is oriented at a first angle in the range of 15 to 60° to the component plane and/or an outer wall of the nozzle facing the heating portion at least partially encloses a second angle in the range of 15 to 60° with the component plane.

The first angle is defined between the component plane and the direction in which the cooling fluid is discharged from the nozzle. If this takes place in the form of a flat jet, the first angle is defined between the center line of the flat jet, i.e., between the axis of the flat jet, and the component plane.

Preferably, a planar portion of the outer wall of the nozzle facing the heating portion encloses a second angle in the range of 15 to 600 with the component plane. This planar portion preferably extends up to the nozzle opening. As a result of this embodiment, the air entrained by the cooling fluid flows along a straight flow path, immediately before the air leaves the outer wall of the nozzle. This allows this air to reach the component surface in a particularly uniform manner. This makes it possible to prevent the cooling fluid and/or entrained air from entering the heating portion. In addition, the second region can thus be cooled in a particularly uniform manner. For this purpose, it is particularly preferred for the outer wall of the nozzle facing the heating portion to be formed parallel to the fluid channel outside of the straight portion of the fluid channel. This means that the straight portion of the fluid channel is delimited on its side facing the heating portion by an outer wall of constant thickness. As a result, the cooling fluid within the fluid channel and the air entrained by the cooling fluid flow on the outer wall of the nozzle via mutually parallel, straight flow paths before the cooling fluid and the air leave the nozzle. This results in a particularly uniform flow.

Preferably, the nozzle is oriented at a first angle in the range of 15 to 600 to the component plane and the outer wall of the nozzle facing the heating portion at least partially encloses a second angle in the range of 15 to 600 with the component plane. Particularly preferably, the first and the second angles are the same size. Preferably, the first angle and/or the second angle are each 45°.

BRIEF DESCRIPTION OF THE DRAWINGS

The invention is explained in more detail below with reference to the drawings. The drawings show a particularly preferred embodiment, to which the invention is not limited, however. The drawings and the proportions shown therein are only schematic. In the drawings.

DETAILED DESCRIPTION

Figure 1:
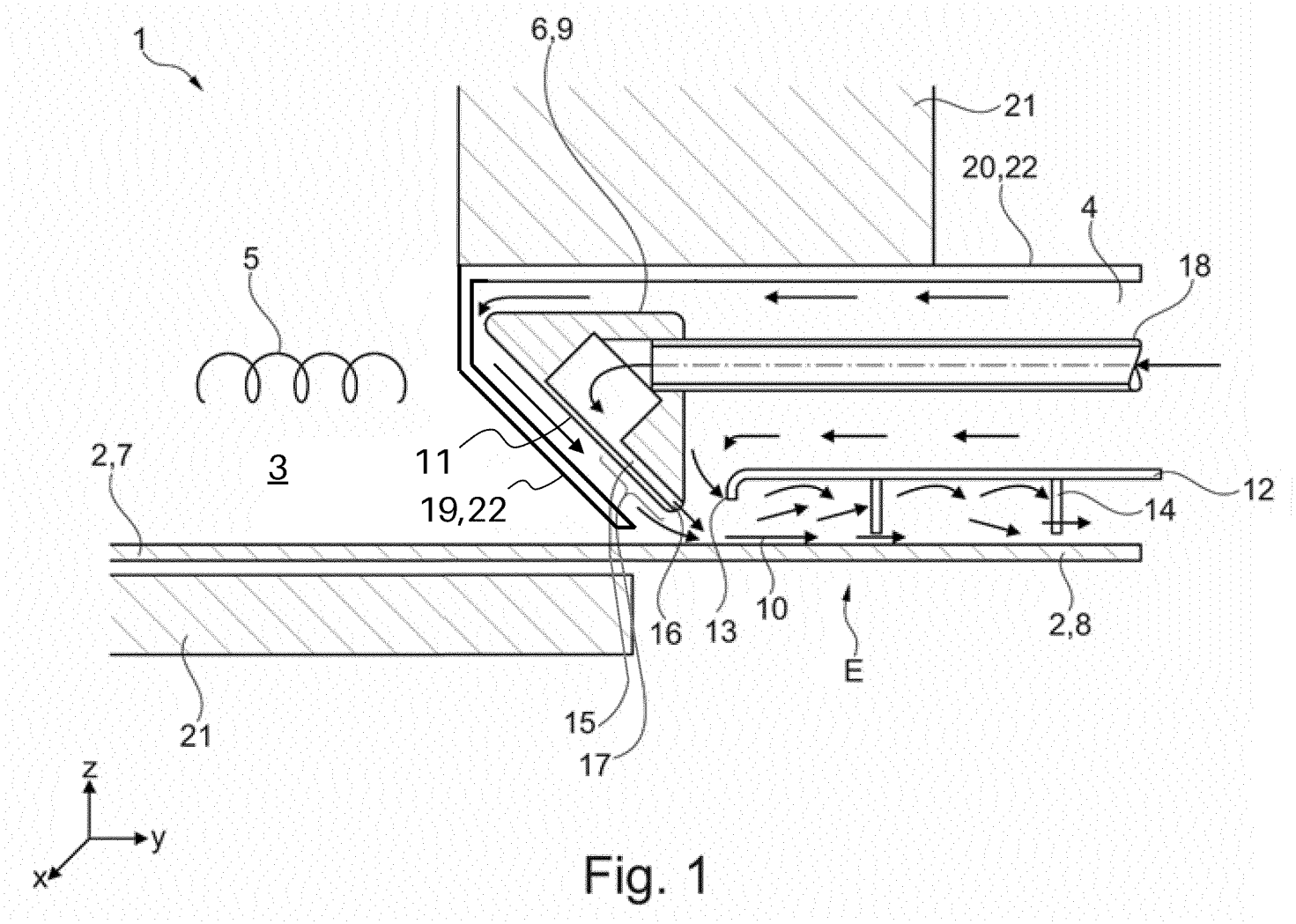
FIG. 1: shows a sectional view of an apparatus according to the invention for the thermal treatment of a component.

FIG. 1 shows an apparatus 1 for the thermal treatment of a component 2. The apparatus 1 is described using a coordinate system which has a first direction x, a second direction y and a third direction z, which are perpendicular to one another in pairs. The first direction x and the second direction y together define a plane which is referred to as the component plane E. The component 2 lies in the component plane E (wherein an extension of the component 2 in the third direction z is disregarded).

The apparatus 1 comprises a heating portion 3 with a heating means 5 for heating a first region 7 of the component 2 and a cooling portion 4 with a cooling means 6 for cooling a second region 8 of the component 2. The cooling portion 4 is downstream of the heating portion 3 in the second direction y, i.e., it is arranged to the right of the heating portion 3 in the illustration.

The cooling means 6 has a nozzle 9 for discharging a cooling fluid 10 onto the component 2. The cooling fluid 10 is indicated by arrows. The cooling fluid can be supplied to the nozzle 9 via a connection 18.

In the second direction y, the nozzle 9 is oriented such that it drops. This means that the nozzle 9 discharges the cooling fluid 10 to the bottom right in the illustration of FIG. 1. The nozzle 9 has a fluid channel 15 with a nozzle opening 16 and a straight portion 17 upstream of said nozzle opening. In addition, an outer wall 11 of the nozzle 9 facing the heating portion 3 also drops in the second direction y. In the embodiment shown, the outer wall 11 is formed parallel to the straight portion 17 of the fluid channel 15.

The apparatus 1 further comprises a nozzle box 22 with a partition wall 19 between the heating portion 3 and the cooling portion 4 and with a cover plate 20, which is arranged in the cooling portion 4 above the nozzle 9. The outer wall 11 of the nozzle 9 facing the heating portion 3 is spaced apart from the partition wall 19 in the second direction y. The partition wall 19 is oriented parallel to the outer wall 11.

The apparatus 1 also comprises a guide plate 12, which is arranged in the cooling portion 4 on a side of the nozzle 9 facing away from the heating portion 3 and parallel to the component plane E. An edge 13 of the guide plate 12 facing the nozzle 9 is rounded. This is the left edge of the guide plate 13 in the illustration of FIG. 1. This is bent downwards and thus rounded. A plurality of spacer pins 14 is arranged on the guide plate 12 in order to hold the component 2 at a distance from the guide plate 12.

The apparatus 1 further comprises insulation 21 below the heating portion 3 and above the nozzle box 22.

Figure 2:
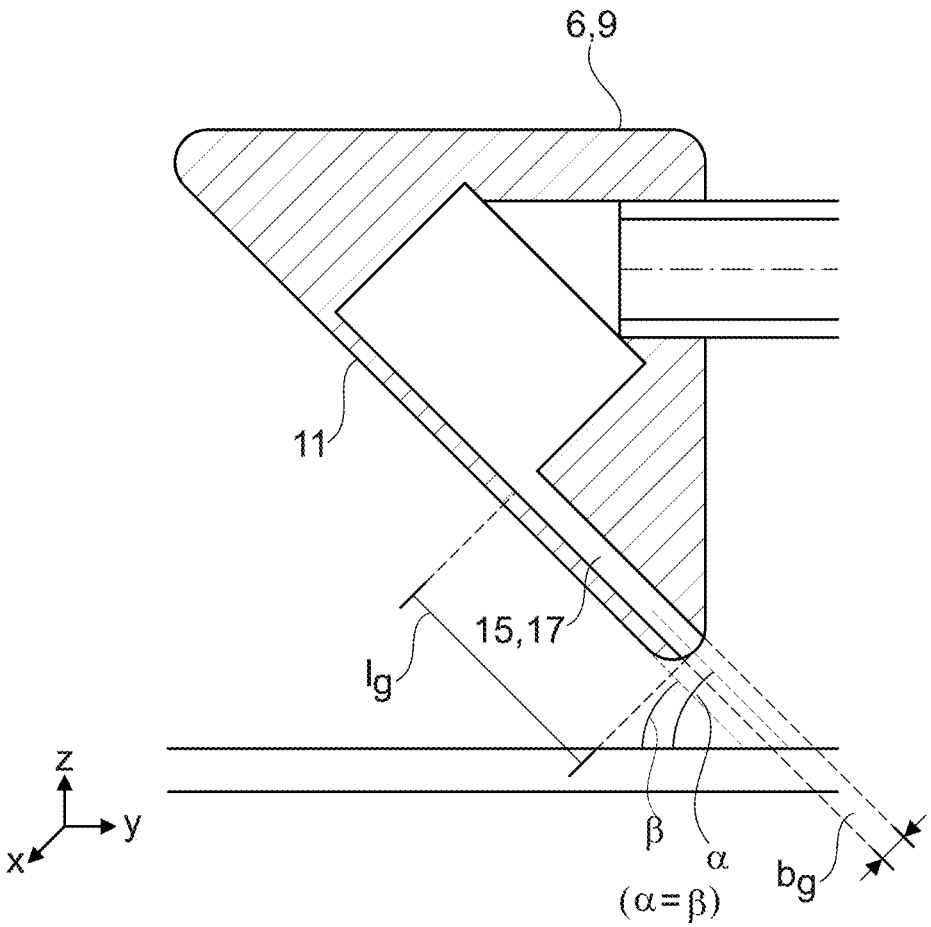
FIG. 2: shows an enlargement of the nozzle of the apparatus from FIG. 1, and FIG. 3: shows a flow cross section of the nozzle of the apparatus from FIG. 1.

FIG. 2 shows an enlargement of the nozzle 9 from FIG. 1. The nozzle 9 is part of the cooling means 6. In particular, the straight portion 17 of the fluid channel 15 can be seen. In addition, the outer wall 11 facing the heating portion 3 (not shown here) can be seen. A length $l_g$ of the straight portion 17 of the fluid channel 15 is also indicated. This is at least 5 mm. In addition, a width $b_g$ of the fluid channel 15 perpendicular to the first direction x is indicated. This has a uniform value in the range of 0.1 to 3 mm. Furthermore, a first angle α is indicated at which the nozzle 9 is aligned with the component plane E. A second angle β is also indicated, which encloses the outer wall 11 of the nozzle 9 facing the heating portion 3 with the component plane E. In the embodiment shown, the first angle and the second angle are equal and are in the range of 15 to 60°.

Figure 3:
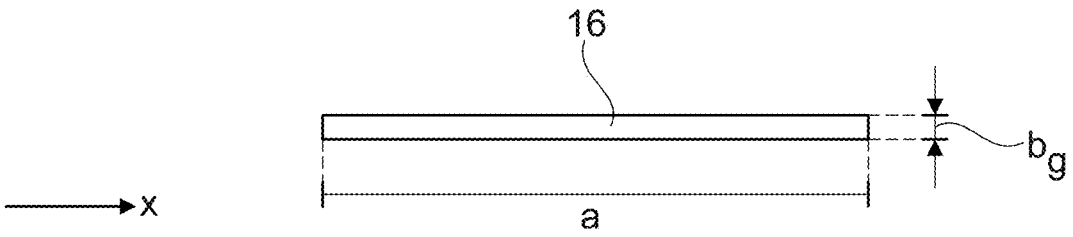

FIG. 3 shows a flow cross section of the nozzle of the apparatus from FIG. 1. The nozzle opening 16 is indicated, the width $b_g$ of which corresponds to the width of the straight portion 17 of the fluid channel 15. In addition, an expansion a of the nozzle opening 16 in the first direction x is indicated.

By means of the described apparatus 1, components 2, more particularly steel components for motor vehicles, can be thermally treated individually in different regions, wherein a particularly defined delimitation between the regions 7, 8 is possible. For this purpose, the nozzle 9 is directed away from the heating portion 3 and has a fluid channel 15 having a nozzle opening 16.

LIST OF REFERENCE SIGNS

1 Apparatus
2 Component
3 Heating portion
4 Cooling portion
5 Heating means
6 Cooling means
7 First region
8 Second region
9 Nozzle
10 Cooling fluid
11 Outer wall
12 Guide plate
13 Edge
14 Spacer pin
15 Fluid channel
16 Nozzle opening
17 Straight portion
18 Connection
19 Partition wall
20 Cover plate
21 Insulation
22 Nozzle box
x First direction
y Second direction
z Third direction
E Component plane
lg Length of the straight portion
bg Width of the straight portion
a Expansion of the nozzle opening
α First angle
β Second angle

The invention claimed is:

1. An apparatus for thermal treatment of a component, which can be arranged in a component plane (E) in the apparatus, wherein the component plane (E) is spanned by a first direction (x) and a second direction (y) perpendicular to the first direction, the apparatus comprising a heating portion for heating a first region of the component, a cooling portion having a cooling means for cooling a second region of the component, wherein the cooling portion is downstream of the heating portion in the second direction (y), wherein the cooling means has a nozzle for discharging a cooling fluid onto the component, wherein the nozzle is oriented such that it drops in the second direction (y), and toward the component plane (E), and wherein the nozzle has a fluid channel having a nozzle opening, and a partition wall between the heating portion and the cooling portion, wherein an outer wall of the nozzle facing the heating portion is spaced apart from the partition wall and is oriented parallel to the partition wall in the second direction (y), wherein the outer wall of the nozzle facing the heating portion drops at least partially in the second direction (y) and towards the component plane (E).

2. The apparatus of claim 1, wherein the fluid channel has a straight portion upstream of the nozzle opening having a length ($l_g$) of at least 5 mm.

3. The apparatus of claim 1, further comprising a cover plate which is arranged in the cooling portion above the nozzle.

4. The apparatus of claim 1, further comprising a guide plate which is arranged in the cooling portion on a side of the nozzle facing away from the heating portion and parallel to the component plane (E).

5. The apparatus of claim 4, wherein an edge of the guide plate facing the nozzle is bent downward toward the component plane (E).

6. The apparatus of claim 4, wherein at least one spacer pin is arranged on the guide plate in order to hold the component at a distance from the guide plate.

7. The apparatus of claim 1, wherein the fluid channel has a uniform width ($b_g$) in a range of 0.1 to 3 mm in a portion upstream of the nozzle opening perpendicular to the first direction (x).

8. The apparatus of claim 1, wherein the nozzle is oriented at a first angle ($\alpha$) defined between the component plane and the direction in which the cooling fluid is discharged from the nozzle in a range of 15 to 600 to the component plane (E), and/or wherein an outer wall of the nozzle facing the heating portion encloses a second angle ($\varphi$ in a range of 15 to 60° with the component plane (E).

* * * * *